US008324541B2

(12) United States Patent
Shirokawa et al.

(10) Patent No.: US 8,324,541 B2
(45) Date of Patent: Dec. 4, 2012

(54) HIGH-FREQUENCY HEATING DEVICE

(75) Inventors: Nobuo Shirokawa, Nara (JP); Shinichi Sakai, Nara (JP); Hideaki Moriya, Nara (JP); Haruo Suenaga, Osaka (JP); Manabu Kinoshita, Nara (JP)

(73) Assignee: Panasonic Corporation, Osaka (JP)

( * ) Notice: Subject to any disclaimer, the term of this patent is extended or adjusted under 35 U.S.C. 154(b) by 1104 days.

(21) Appl. No.: 12/160,243

(22) PCT Filed: Jan. 9, 2007

(86) PCT No.: PCT/JP2007/050106

§ 371 (c)(1),
(2), (4) Date: Jul. 8, 2008

(87) PCT Pub. No.: WO2007/080859

PCT Pub. Date: Jul. 19, 2007

(65) Prior Publication Data

US 2009/0001074 A1 Jan. 1, 2009

(30) Foreign Application Priority Data

Jan. 12, 2006 (JP) ..... 2006-005316

(51) Int. Cl.
*H05B 6/68* (2006.01)
*H05B 6/66* (2006.01)

(52) U.S. Cl. ..... 219/721; 219/715; 219/761

(58) Field of Classification Search ..... 219/721, 219/702, 704, 715–716, 723, 756, 762, 763, 219/761; 363/49, 97, 37, 41, 74, 98; 361/713, 361/718, 719
See application file for complete search history.

(56) References Cited

U.S. PATENT DOCUMENTS

| | | | | |
|---|---|---|---|---|
| 6,462,319 | B1 | 10/2002 | Uy et al. | |
| 6,878,910 | B2 | 4/2005 | Kim et al. | |
| 2009/0272735 | A1 * | 11/2009 | Suenaga et al. | 219/702 |

FOREIGN PATENT DOCUMENTS

| | | |
|---|---|---|
| JP | 3-46993 | 4/1991 |
| JP | 05-205868 | 8/1993 |
| JP | 10-172749 | 6/1998 |
| JP | 10-284245 | 10/1998 |
| JP | 2001-015260 | 1/2001 |
| JP | 2003-086347 | 3/2003 |
| RU | 2088050 C1 | 8/1997 |
| RU | 2259644 C2 | 8/2005 |

OTHER PUBLICATIONS

International Search Report Dated Apr. 10, 2007.
Russian Decision to Grant Patent for Invention issued on Mar. 17, 2010.

* cited by examiner

*Primary Examiner* — Quang Van
(74) *Attorney, Agent, or Firm* — Pearne & Gordon LLP

(57) ABSTRACT

To attain a more reliable prevention of an electric shock by checking whether the earth states for two circuit boards are good. There is detected a voltage generated at an anode current sensing resistor 20 inserted into a path where the anode current of a magnetron 8 flows and a signal is transmitted to a microcomputer 27. The microcomputer 27 uses a selector switch 28 to determine the earth states for an inverter circuit board and a control panel circuit board before operation of a device. In case either one or both of the circuit boards are in a floating state, operation of a high-frequency heating device is inhibited. Otherwise, operation of the high-frequency heating device is permitted.

8 Claims, 9 Drawing Sheets

| STATE | Tr-X | Tr-Y | MODE | VOLTAGE AT 35 |
|---|---|---|---|---|
| 1 | ON | OFF | OUTPUT | Vcc |
| 2 | OFF | ON | MODE | GND |
| 3 | OFF | OFF | INPUT | Hi-Z |

HIGH-FREQUENCY HEATING DEVICE

TECHNICAL FIELD

The present invention discloses a technique related to high-frequency heating by a device using a magnetron such as a microwave oven and, in particular, a technique related to prevention of an electric shock to a person operating the device.

BACKGROUND ART

FIG. 7 is a diagram of a related art high-frequency heating device (magnetron) (refer to Patent Reference 1). In FIG. 7, the AC power of a commercial power source 113 is waveform-shaped into a unilateral power by a rectifier filter 101 composed of a diode bridge 134 for rectifying the full waves of an AC waveform and a low-pass filter formed by a choke coil 119 and a smoothing capacitor 120. The unilateral power is converted to a high-frequency power of 20 to 50 kHz by an inverter 102 including a resonant circuit constituting a tank circuit with the inductance components of a resonance capacitor 121 and a transformer 107 and switching elements such as a power transistor 125 and a flywheel diode 122 serially connected to the resonance circuit. The high-frequency power generated on the primary side of the boosting transformer 107 is boosted by the boosting transformer 107 to generate a high-voltage high-frequency power on the secondary side. A circuit connected to the secondary side of the boosting transformer 107 is a high-voltage circuit 104 of a half-wave voltage doubler rectification system composed of a high-voltage capacitor 126 and a high-voltage diode 127. The high-voltage circuit 104 applies a high DC voltage (for example −4 kV) across the anode and cathode of a magnetron 106. Power is supplied from another secondary wiring 128 of the boosting transformer 107 to the heater of the magnetron 106 thus heating the cathode and causing electrons to reach the anode. This irradiates microwave energy onto an object to be heated in an oven chamber.

An inverter control circuit 103, receiving a setting output command Vref signal from a control panel 108, uses PWM control to vary On/Off of the power transistor 125 of the switching element to control supply of electric power to the secondary side thus controlling the strength of the microwave output from the magnetron. Blocks 101, 102, 103 and 104 surrounded by dotted lines are formed into an inverter circuit board 105 as a single unit by arranging a plurality of components on a printed circuit board. The interface between the inverter circuit board 105 and peripheral components is coupled at the connection parts CN1 to CN4 (numerals 109 to 112).

For the operation in the inverter control circuit 103 and PWM control, the earth of the high-voltage circuit 104 is connected to a chassis potential via an anode current resistor 135 composed of a resistor group and a connection part 109. The anode current of the magnetron 106 flows therein. The product of the anode current and the voltage applied across the anode and cathode of the magnetron 106 is the power inputted to the magnetron 106. With this configuration, it is possible to measure the value of the anode current once the voltage drop Via in the anode current sensing resistor 135 is detected. It is thus possible to convert a current to a voltage using a low-cost fixed resistor rather than using an expensive insulating type current transformer, thereby implementing an extremely economical current detector.

An anode current of several hundreds of milliamperes flows through the sensing resistor 135. The number of resistors connected in parallel (for example, resistors 142 to 144) and a constant should be determined so that the power loss of the resistor will fall within the rating and that the generated voltage will be easily handled by a circuit in the subsequent stage. The Via signal detected by the anode current sensing resistor 135 is inputted to a negative feedback controller 136. The deviation from the Vref signal coming from the control panel 108 is calculated and negative-feedback amplification is made to control the PWM output of the inverter 102 via a driving control amplifier circuit 168, thereby performing negative-feedback control of the magnetron 106 and making control to keep constant the anode current (refer to Patent Reference 1).

However, with the related art magnetron driving power source shown in FIG. 7, in case a fault should take place where the sensing resistor 135 is placed in the open mode (earth floating state) due to some cause such as breakage by extraneous electromagnetic wave energy, breakage under severe environment and mixing of faulty components, the high voltage of −4 kV or the like in the voltage doubler rectifier circuit 104 could be induced also into the control panel 108 operated by the user with their hands, thus causing a risk of an electric shock to the user. As a means for avoiding this risk, the high-frequency heating device shown in FIG. 8 arranges a protective capacitor 219 parallel to the sensing resistor 216 for detecting the anode current of the magnetron. The protective capacitor 219 is designed to have a larger capacitance value than that of a high-voltage capacitor 212 or a through-capacitor (not shown) while the sensing resistor 216 is in the open mode. With the operation of the protective capacitor 219, the high voltage is divided by the high-voltage capacitor 212, the through-capacitor and the protective capacitor 219, and the protective capacitor 219 is maintained at a low voltage value or at a low potential close to zero potential, which provides safety. This prevents a control panel circuit board 218 from floating at a high voltage even in the presence of open failure of the sensing resistor 216 thus assuring a safe configuration.

While the half-wave voltage doubler rectifier circuit has been described, it is also possible to provide safety to a full-wave voltage doubler rectifier circuit by way of the totally same configuration (refer to Patent Reference 2).

In the microwave oven shown in FIG. 9, in the event of a wire break in a conductor pattern 319*a* or 319*b* on an inverter circuit board 312 to which anode current sensing resistors 318*a* to 318*d* are connected, the resistance value of the anode current sensing resistor 318 increases and a drop in the voltage caused by an anode current increases. This leads to a higher level of the anode current sensing signal inputted to a control panel 322. Thus, the microwave oven is designed to detect a wire break and shut down the inverter operating when the level has risen abnormally thus preventing generation of sparks in a wire break section of the conductor pattern 319*a* or 319*b*. This reliably prevents burning or an electric shock caused by sparks (refer to Patent Reference 3).

Patent Reference 1: JP-A-10-172749
Patent Reference 2: JP-A-10-284245
Patent Reference 3: JP-A-2001-15260

DISCLOSURE OF THE INVENTION

Problems that the Invention is to Solve

The system for detecting the anode current of a magnetron with the anode current sensing resistor still presents a risk of an electric shock to the user when the earth of an inverter circuit board is placed in the floating state due to breakage or failure of a sensing resistor or a wire break in the conductor pattern on a substrate, unlike a case where an insulating type current transformer is used. Patent Reference 2 describes a configuration where a protective capacitor is arranged parallel to a sensing resistor to divide a high voltage together with a high-voltage capacitor thus reducing the risk of an electric shock. Patent Reference 3 describes a configuration where the resistance value of a sensing resistor increases in the presence of a wire break in the conductor pattern of the inverter circuit board to which the sensing resistor is connected and the operation of the inverter is shut down in the presence of an abnormal rise in the detected current value.

The configuration described in Patent Reference 2 prevents a risk of an electric shock to the user operating the control panel circuit board 218 formed by a separate substrate in the subsequent stage attributable to floating of the earth of an inverter circuit board or the like caused by an abnormality in the sensing resistor 216 provided on the side of the inverter circuit board including a rectifier circuit. While a possible cause of floating is an abnormality in the sensing resistor alone such as a wire break or failure in the sensing resistor 216, failure or an abnormality in the protective capacitor may be a cause of floating. Thus, introduction of the protective capacitor 219 does not offer perfect safety but an abnormality in the protective capacitor 219 leads to the risk of an electric shock to the user, same as an abnormality in the sensing resistor 216. Other causes of earth floating include forgetfulness of earthing or poor clamping force in the procedure for clamping and earthing an enclosure chassis by way of eyelet and screwing in the earth pattern holes in the substrate in the manufacturing process. The earth may be brought into an electrically open state with the chassis loosened during transportation.

Similarly, the configuration described in Patent Reference 3 provides a configuration where the user operating the control panel circuit board 322 is not influenced by sparks caused by a wire break in a conductor pattern 319 connecting the sensing resistor 318 formed on the inverter circuit board 312. The problem is that Patent Reference 3 considers only the earth floating of the inverter circuit board 312. The user is more likely to receive an electric shock when the inverter circuit board and the control panel circuit board are in the floating state although the earth state for the control panel circuit board is not checked. Thus, the state where neither the inverter side nor the control panel side is earthed is not checked perfectly.

An object of the invention is to provide an electric shock prevention technique capable of checking the earth of one substrate such as an inverter circuit board as well as the earth of the other substrate on the side of the inverter circuit board thus attaining more reliably electric shock prevention measures.

Means for Solving the Problems

The invention provides a high-frequency heating device comprising: an inverter for rectifying an AC power and converting the AC power to a high-frequency power; a boosting transformer for boosting a high-frequency power outputted from the inverter; a high-voltage circuit for converting the output of the boosting transformer to a high DC voltage; a magnetron for receiving the high DC voltage and irradiating a microwave; a first current sensing resistor provided on a first path where the anode current of the magnetron flows, the first current sensing resistor detecting the anode current and being connected to the earth of a first circuit board on which at least the high-voltage circuit is arranged; a second current sensing resistor separated from the first current sensing resistor, the second current sensing resistor provided on a second path connected to the first path while branching therefrom and connected to the earth of a second circuit board as a substrate for a control panel the user touches for operation; and a controller for controlling the oscillation of the magnetron by controlling the inverter. The controller applies a predetermined voltage to the first current sensing resistor and the second current sensing resistor while the inverter is not operating to determine the earth states for the first circuit board and the second circuit board, and makes control to inhibit start of operation of the inverter assuming an abnormality when determining that at least one of the earths is imperfect and to permit start of operation of the inverter when detecting that neither the earth state for the first circuit board nor the earth state for the second circuit board is imperfect. With this configuration, the earth states for two circuit boards are detected and in case at least one of the earths is found imperfect, the operation may be shut down thus making the earth check more reliable.

The controller may check the earth states for the first circuit board and the second circuit board in a predetermined cycle even while the inverter and the magnetron are operating. With this configuration, it is possible to restart operation even in the presence of failure in the earth after operation has started.

The high-frequency heating device may be arranged so that the second path is connected to a power potential generating the predetermined voltage and includes a selector switch connected between the power potential and the second current sensing resistor, that the second path connects the power potential to the first path by turning on the selector switch, and that the controller determines the earth states for the first circuit board and the second circuit board assuming a voltage obtained by the second current sensing resistor as the voltage value. With such a simple configuration, it is possible to reliably check the earth state as described above.

The controller may include an input terminal connected to the first path for detecting the voltage value and an output terminal arranged between the second current sensing resistor and the selector switch.

There may be arranged a plurality of resistor elements connected to a subsequent stage of the first current sensing resistor, connected to the earth of the second circuit board and connected parallel to each other. Further, there may be arranged a diode connected to a subsequent stage of the first current sensing resistor and connected to the earth of the second circuit board. With this configuration, it is possible to make prevention of electric shock more reliable.

Advantage of the Invention

The high-frequency heating device according to the invention checks earth floating attributable to any cause for at least two circuit boards before operation. Upon detection of the earth floating state of any one substrate, the high-frequency heating device is not started. This more reliably prevents the user from receiving an electric shock caused by earth floating. After the operation is started, a risk of an electric shock is reduced while the earth state is being checked.

DESCRIPTION OF THE REFERENCE NUMERALS AND SIGNS

Figure 1:
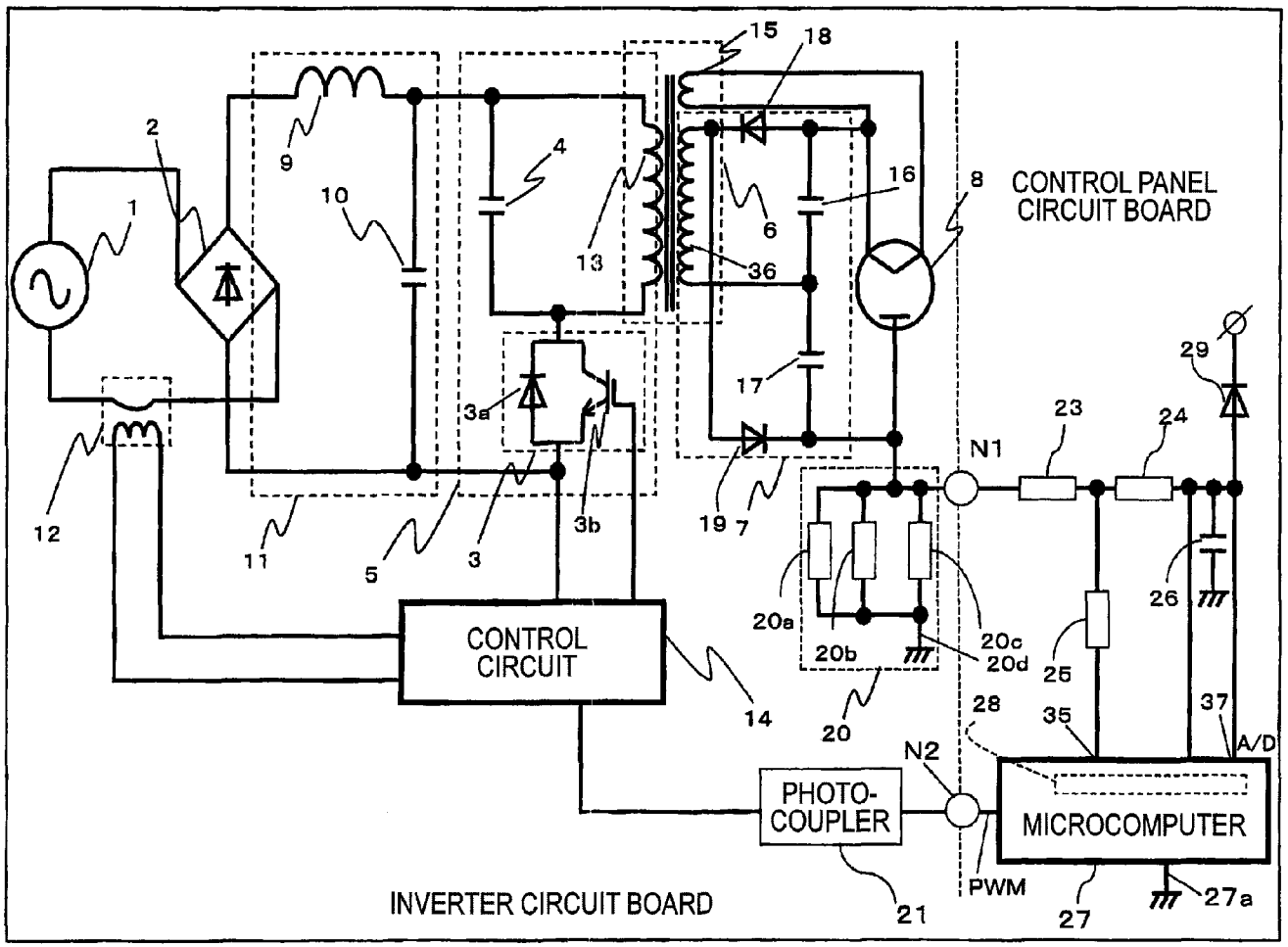
FIG. 1 It is a block diagram of a high-frequency heating device according to Embodiment 1 of the invention.

1: Commercial power source
2: Rectifier circuit
3: Switching element
4: Resonant capacitor
5: Inverter
6: Boosting transformer
7: High-voltage doubler full-wave rectifier circuit
8: Magnetron
9: Choke coil
10: Smoothing capacitor
11: Smoothing circuit
12: Current transformer
13: Primary side coil
14: Inverter control circuit
15: Filament transformer
16, 17: High-voltage capacitor
18, 19: High-voltage diode
20: Current sensing resistor
21: Photocoupler
23, 24: Resistor
25: Current sensing resistor
26: LPF capacitor
27: Microcomputer
28: Selector switch
29: Protective diode
31: Protective resistor
32: Transistor
33: Pullup resistor
34: Resistor
35: Voltage output terminal
36: Secondary side coil
37: A/D converter terminal

BEST MODE FOR CARRYING OUT THE INVENTION

Embodiments of the invention will be described referring to figures.

Embodiment 1

FIG. 1 is a block diagram of a high-frequency heating device according to Embodiment 1 of the invention. The high-frequency heating device includes a bridge rectifier circuit 2 for rectifying the AC power of a commercial power source 1, a smoothing circuit 11, an inverter 5, a boosting transformer 6, a voltage doubler full-wave rectifier circuit 7, a magnetron 8, an inverter control circuit 14, a current sensing resistor (first current sensing resistor) 20, and a microcomputer (controller) 27. The portion except the microcomputer 27 is formed on an inverter circuit board (first circuit board) and the microcomputer 27 is formed on a control panel circuit board (second circuit board). The high-frequency heating device is used as a microwave oven, for example.

The AC power of the commercial power source 1 is rectified with the bridge rectifier circuit 2 into a direct current, smoothed by the smoothing circuit 11 composed of a choke coil 9 and a smoothing capacitor 10 on the output side, and supplied to the input of the inverter 5. The inverter 5 includes a resonant circuit formed by a capacitor 4 and a primary side coil 13 constituting the primary side wiring of the boosting transformer 6 and a semiconductor switching element 3 formed by a diode 3*a* and a transistor 3*b*. The direct current from the smoothing circuit is converted to a desired high-frequency (20 to 40 kHz) through on/off operation of the semiconductor switching element 3 of the inverter 5. The inverter 5 is driven by the inverter control circuit 14 that controls the semiconductor switching element 3 for switching a direct current at high speed. A current flowing through the primary side coil 13 of the boosting transformer 6 is switched by repetition of high-speed on/off operation.

In the boosting transformer 6, a high-frequency voltage as an output of the inverter 5 is supplied to the primary side coil 13. A high voltage corresponding to the ratio of turns between the primary side coil 13 and the secondary side coil 36 is obtained at the secondary side coil 36. On the secondary side of the boosting transformer 6 is arranged a coil 15 with a small number of turns used for heating the filament of the magnetron 8. The output of the boosting transformer 6 is rectified by the voltage doubler full-wave rectifier circuit 7 connected to the secondary wiring and a DC high voltage is applied to the magnetron 8. The voltage doubler full-wave rectifier circuit 7 is composed of high-voltage capacitors 16, 17 and two high-voltage diodes 18, 19. The voltage doubler full-wave rectifier circuit 7 may be of any other type as long as it is a high voltage circuit for converting the output of the pull-up transformer 6 to a high DC voltage.

The magnetron 8 receives the high DC voltage of the voltage doubler full-wave rectifier circuit 7, irradiates a microwave and heats an object to be heated accommodated in the storage box of the device. On the anode side of the magnetron 8 is inserted a current sensing resistor 20 of the magnetron 8. The anode current detected by the current sensing resistor 20 is transmitted to the control panel circuit board as another substrate via a connector N1. The current sensing resistor 20 is composed of a plurality of (three in this case) resistor elements 20*a*, 20*b*, 20*c* connected in parallel as safety measures against wire breaks or the like and is connected to the earth of an inverter circuit board via an earth 20*d* (corresponding to the earth A in FIG. 3).

The inverter control circuit 14 forms a negative feedback control loop for acquiring the level and waveform information of the inverter current from a current transformer 12 and acquiring the anode current data of the magnetron 8 from the control panel via a connector N2 and an insulating photocoupler 21, and calculating a deviation. The inverter control circuit 14 uses a sawtooth generator, PWM (Pulse Width Modulation) comparator or the like to generate a PWM signal and drives to turn on/off the semiconductor switching element 3. This is the end of explanation of the configuration included by the inverter circuit board. The inverter for rectifying an AC power and converting the same to a high-frequency power is composed of a bridge rectifier circuit 2, a smoothing circuit 11, an inverter 5, and an inverter control circuit 14 although the configuration of the inverter is not particularly limited to that of the embodiment.

Next, on the control panel circuit board, the anode current detected by the current sensing resistor 20 transmitted via the connector N1 as a connection part to the inverter circuit board is smoothed via a low-pass filter composed of an input resistor 23, a resistor 24 for eliminating high-frequency noise and a capacitor 26, and inputted to the A/D converter terminal 37 of a microcomputer 27. Between the A/D converter terminal 37 and a Vcc power source is inserted a diode 29 for preventing backflow and protecting a circuit. The A/D converter terminal 37 performs analog-to-digital conversion of the anode current and converts the current to a voltage. Between the resistor 23 and the resistor 24 is arranged a branch line as mentioned later. A current sensing resistor 25 used to determine the earth connection state in cooperation with the microcomputer 27 is provided on the branch line. The internal circuit of the microcomputer 27 is connected to the earth of a control panel circuit board via an earth 27*a* (corresponding to the earth B in FIG. 3).

In this invention, earth floating (disengaged earth, earth abnormalities) for both the inverter circuit board and the control panel circuit board before operation. This check is made by using a selector switch 28 housed in the microcomputer 27. Only in case the check result is normal, the microcomputer 27 outputs an enable signal to transmit a PMW output command to the inverter control circuit 14 via the connector N2 and the photocoupler 21, starts operation, and makes open its voltage output terminal 35. In case earth floating of any substrate is detected in the earthing check using the selector switch 28, an error indication is given and operation is inhibited.

Operation of thus configured high-frequency heating device will be described referring to the processing flowchart of FIG. 2.

First, the relay (not shown) of the power source of the high-frequency heating device is charged to turn on the power and a pre-operation check is started with the actual PWM operation inhibited (step S100). The inspection procedure program used here is stored in the memory inside the microcomputer 27.

In this invention, after the power is turned on, not only the earth floating of the inverter circuit board caused by an accident such as a wire break in the current sensing resistor 20 or its peripheral pattern but also the control panel circuit board is checked at the same time. Both the inverter circuit board and the control panel circuit board are checked at the same time by using the selector switch 28 housed in the microcomputer 27 while considering, for both substrates, even a state where neither the inverter circuit board nor the control panel circuit board is earthed at the same time in correspondence to any possible cause of earth floating such as breakage of components, pattern wire break, faulty components, forgetfulness of earthing in the manufacturing process, and imperfect or loose clamping of the substrate earth for the chassis.

Figure 3:
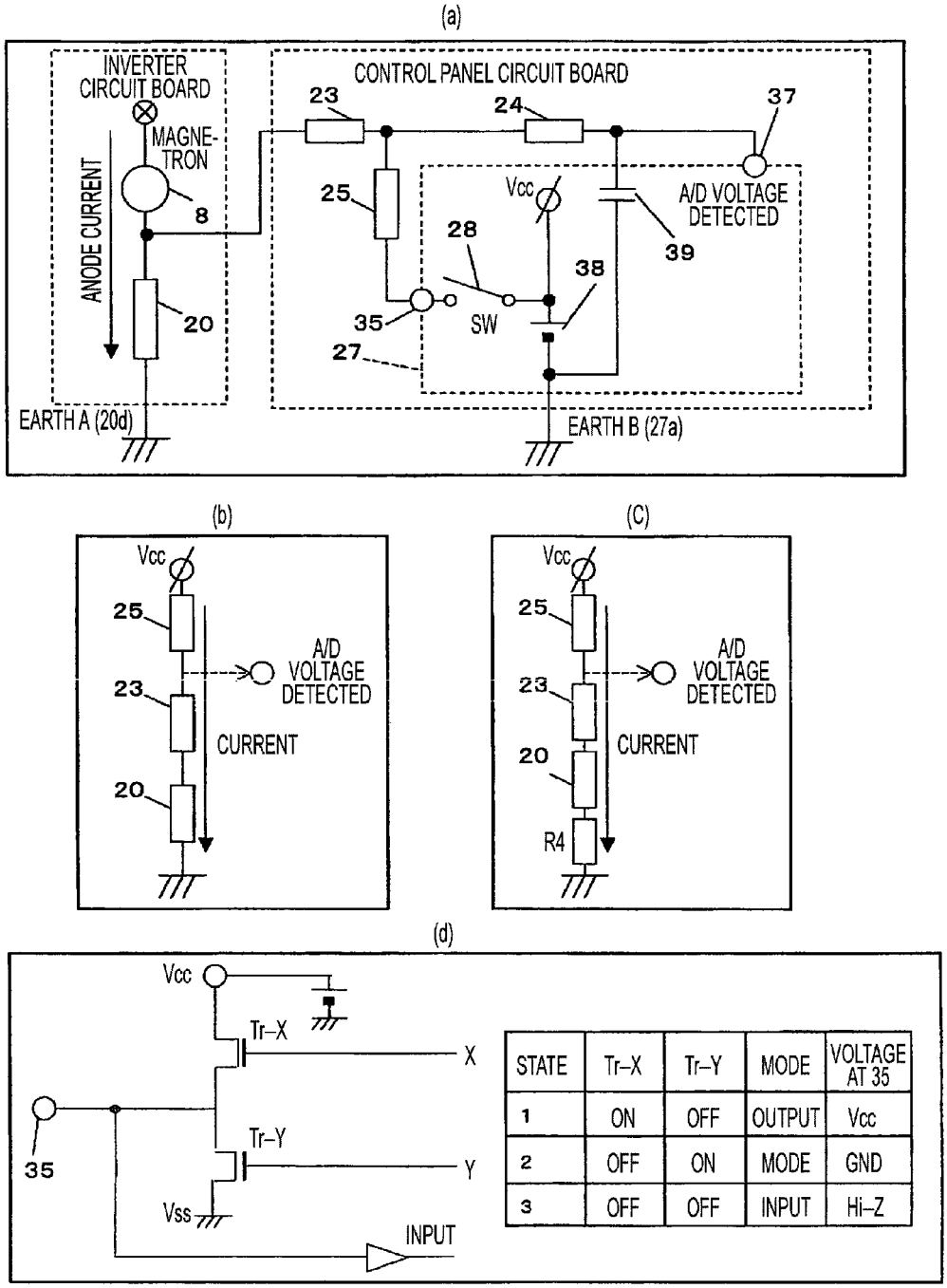
FIG. 3 It is a conceptual diagram showing a configuration for detecting an abnormality in the earth.

As shown in FIG. 3, the microcomputer 27 includes a selector switch 28, a power source 38 and a capacitor 39 connected to a power potential Vcc. In other words, a branch line (second path) including the resistor 25, the voltage output terminal 35, the selector switch 28, a power source 38 and a capacitor 39 is provided in the middle of an anode current main detection line (first path) formed across the inverter circuit board and the control panel circuit board and reaching the A/D converter terminal 37 via the resistor 20, the connector N2, and the resistors 23, 24. This branch line is connected to the power potential Vcc and generates a voltage for detecting earth floating.

In this embodiment, the selector switch 28 is turned on/off and detects the earth state for each of the inverter circuit board and the control panel circuit board based on the voltage detected when the selector switch 28 is turned on or off.

A three-state output circuit shown in FIG. 3(*d*) used in a general microcomputer 27 may be used as a selector switch. As shown in the chart of FIG. 3(*d*), when the transistor Tr-x connected to the high-side power source Vcc is turned on, the voltage at the voltage output terminal 35 becomes Vcc (State 1). When the transistor Tr-y connected to the low-side power source Vss (same potential as GND in this example) is turned on, the voltage at the voltage output terminal 35 becomes Vss (GND) (State 2). When both Tr-x and Tr-y are turned off, the voltage output terminal 35 is brought into an input state (high impedance; Hi-Z) (State 3) thus ensuring signal input to other circuits in the microcomputer 27. The name of the three-state output terminal (circuit) comes from the fact that one of the three states can be controlled (selected) in the microcomputer 27. This feature may be used to switch to an external circuit. As understood from the description that follows, State 1 corresponds to the closed state of the selector switch 28. State 3 corresponds to the open state of the selector switch 28. The feature corresponding to State 2 is not used in this example so that the transistor Tr-y is always off.

In this embodiment, during normal operation of the magnetron, the selector switch 28 is turned off (made open) and the anode current of the magnetron is detected as the voltage of the resistor 20 by the A/D converter terminal 37, as shown in FIG. 3(*a*).

In the earth check (pre-operation check mode and in-operation check mode), the selector switch 28 is turned on (closed) in a state where a current is not flowing through the magnetron (non-operational state). The resistor 25 is then connected to Vcc and the voltage at the A/D converter terminal 37 is detected in this state.

In case both the earth A and the earth B of the inverter circuit board and the control panel circuit board are normal, a current flows as shown in the equivalent circuit of FIG. 3(*b*), so that a voltage divided by the resistors 20, 23, 25 is detected at the A/D converter terminal 37. In case at least one of the earth A and the earth B is open, a current does not flow in the equivalent circuit and the power potential Vcc is detected at the A/D converter terminal 37.

In case at least one of the earth A and the earth B is imperfect (having a certain resistance value), this state is equivalent to addition of a resistor R4 as shown in the equivalent circuit of FIG. 3(*c*) and a divided voltage including the earth resistor R4 is detected at the A/D converter terminal 37. The determination processing of the microcomputer 27 may be preset so that, in case the detected voltage is above a predetermine threshold A, the earth state will be determined abnormal (impermissible imperfect state) and in case the detected voltage is below the predetermine threshold A, the earth state will be determined normal (permissible imperfect state). In this way, the voltage detected at the A/D converter terminal 37 varies depending on the earth state. It is thus possible to determine whether earthing is correct for each substrate based on such variations.

Figure 2:
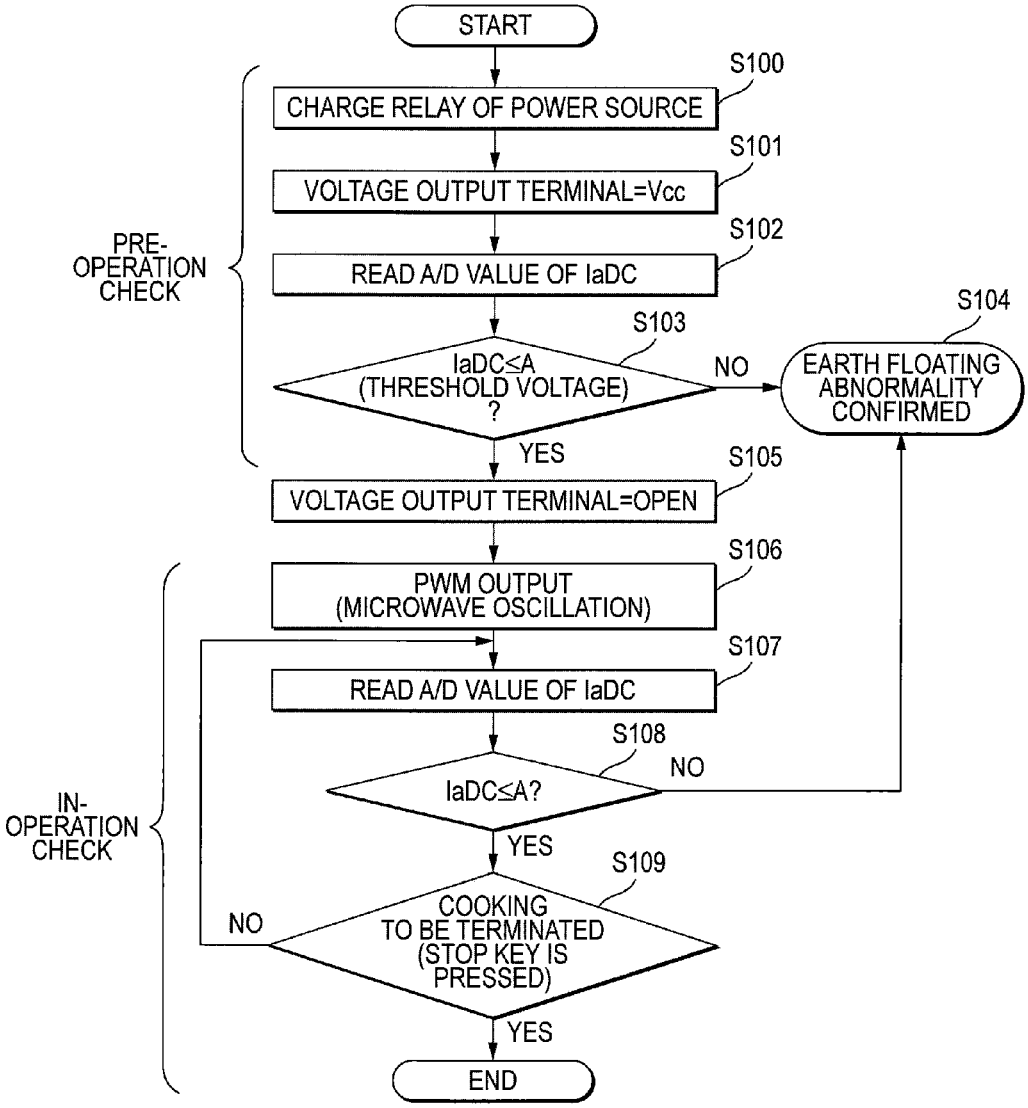
FIG. 2 It is an operation flowchart of the high-frequency heating device shown in FIG. 1.

Returning to the flowchart of FIG. 2, the processing procedures of the above operation will be detailed. The microcomputer 27 checks the Vcc voltage value at the voltage output terminal 35 to check whether the selector switch 28 is turned on (step S101). Connection of the control panel circuit board in FIG. 1 shows connection during normal operation in which PWM is outputted. From this state, the operation mode is switched to the pre-operation check mode and the selector switch 28 is turned on in order to perform pre-operation check. The above processing is to confirm that the pre-operation check mode is activated as described above.

Next, the A/D converter terminal 37 of the microcomputer 27 is used to read the voltage value IaDC input that is based on the anode current of the magnetron 8 (step S102). Then it is determined whether the read input voltage value is smaller than the threshold A (step S103). In a state where at least the earth of one of the inverter circuit board and the control panel circuit board is floating or imperfect (the "imperfect state" generally refers to both the floating state and the imperfect state), the voltage IaDC detected at the A/D converter terminal 37 is greater than the threshold A (NO in step S103). The microcomputer 27 determines an abnormality in the earth and gives an error indication without driving the high-frequency heating device (step S104).

In case the earth is normal, IaDC is greater than or equal to the threshold A (YES in step S103). It is determined that the earth is normal for the inverter circuit board and the control panel circuit board. The voltage output terminal 35 subjected to pre-operation check is made open (the selector switch 28 is made open). The branch line including the selector switch 28 is separated from the anode current main detection line (step S105) and a PWM output command is transmitted to the inverter control circuit 14 via the photocoupler 21, and the magnetron 8 is oscillated (step S106).

The above procedure pertains to the earth floating check before main operation (heating operation) of the high-frequency heating device. There could be a little possibility of earth floating caused by loosened earth clamping or breakage of components even during operation of the device (main operation). Thus, operation check is made in a predetermined cycle also during operation of the inverter or magnetron.

The A/D inverter terminal 37 is used to read the voltage value IaDC input that is based on the anode current of the magnetron 8 (step S107), same as step S102. It is determined, same as step S102, whether the read input voltage value is smaller than the threshold A (step S108). In case the voltage value is greater than the threshold (NO in step S108), an abnormality in the earth is determined and an error indication is given while further operation is being inhibited (step S104). In case the voltage value is smaller than the threshold (YES in step S108), it is determined that the earth is normal for both substrates and operation is continued. It is determined whether cooking is to be terminated (whether the stop key is pressed) (step S109). In case cooking is to be continued, execution returns to step S107 (NO in step S109). In case cooking is to be terminated, cooking is terminated (YES in step S109).

The microcomputer 27 includes a determination part that determines, together with the A/D converter terminal 37 for obtaining a voltage value corresponding to the anode current detected by two current sensing resistors, the earth state for each of the two circuit boards based on the voltage value at least before the start of operation of the device to determine whether to permit operation of the device based on the earth state. While the microcomputer 27 is generally provided as a chip where the components are designed integrally, the detailed aspect thereof is not particularly limited but an A/D converter terminal, a determination part and a memory including a processing program may be separately provided.

Embodiment 2

Figure 4:
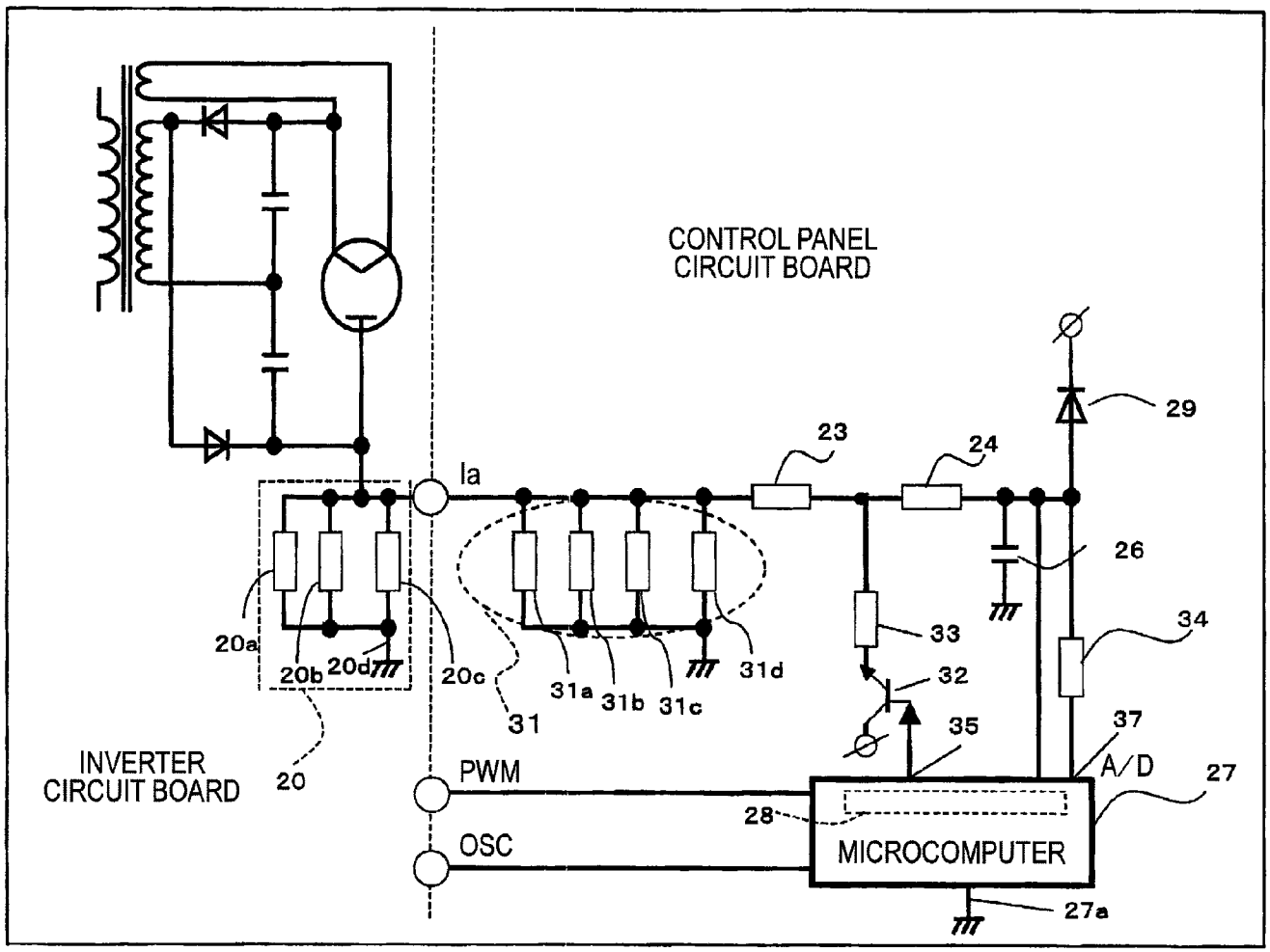
FIG. 4 It is a block diagram of a high-frequency heating device according to Embodiment 2 of the invention.

Embodiment 2 of the invention will be described referring to figures. FIG. 4 is a block diagram of a control panel circuit board of a high-frequency heating device according to Embodiment 2 of the invention.

Embodiment 2 relates to improvement of the safety of the control panel circuit board and stabilization of detection input of the A/D converter terminal 37 shown in Embodiment 1.

In Embodiment 2, the current sensing resistor 20 is composed of a plurality of resistor elements 20*a*, 20*b*, 20*c* connected parallel to each other and is provided on an inverter circuit board. The plurality of resistor elements are connected to the earth in order to reduce the risk of an electric shock caused by floating (disconnection) of a single component from the earth due to open failure. A resistor 31 composed of a plurality of resistor elements 31*a*, 31*b*, 31*c*, 31*d* connected parallel to each other is provided on the control panel circuit board in the subsequent stage of the current sensing resistor 20. All the resistor elements of the resistor 31 on the control panel circuit board remain connected to the earth even in the presence of earth floating for the inverter circuit board, thus ensuring prevention of an electric shock more reliably. The synthetic resistance value assumed when all resistor elements of the resistor 20 on the inverter substrate and the resistor 31 on the control substrate are connected to the earth without components failure, that is, the output voltage value IaDC (in operation) obtained based on the anode current assumed when all resistor elements are normal and the check voltage value obtained while a current is not flowing in the magnetron, that is, before operation, are stored into the microcomputer 27. Operation is shut down in case the voltage value has exceeded the threshold so as to provide safety.

Figure 5:
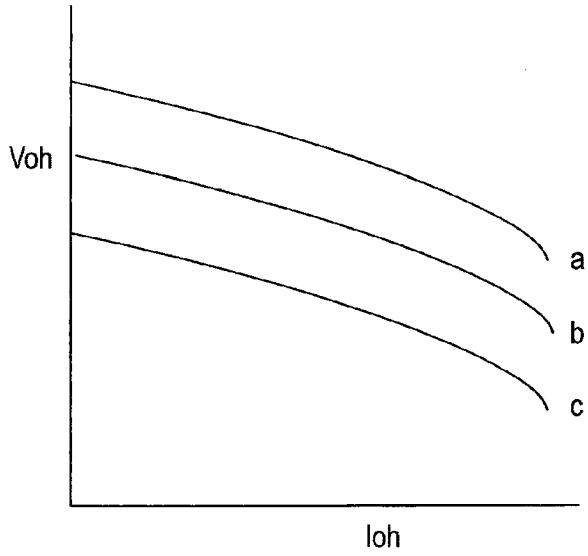
FIG. 5 It shows the V-I characteristic of the microcomputer shown in FIG. 4.

Further, a single buffer circuit using a transistor 32 and a pullup resistor 33 is arranged in a stage before the A/D converter terminal 37 of the microcomputer 27. The microcomputer used in this example is an off-the-shelf product. Thus, there are considerable variations between products as shown in the VI characteristic chart of FIG. 5. Detection errors are likely to occur so that a single buffer circuit is added to eliminate the differences found in the comparison curves of multiple microcomputers a, b, c shown in FIG. 5. In other words, an external transistor 32 is used and turned on/off by the microcomputer 27 in order to enhance the precision without being influenced by the VI characteristic of the microcomputer 27.

Embodiment 3

Figure 6:
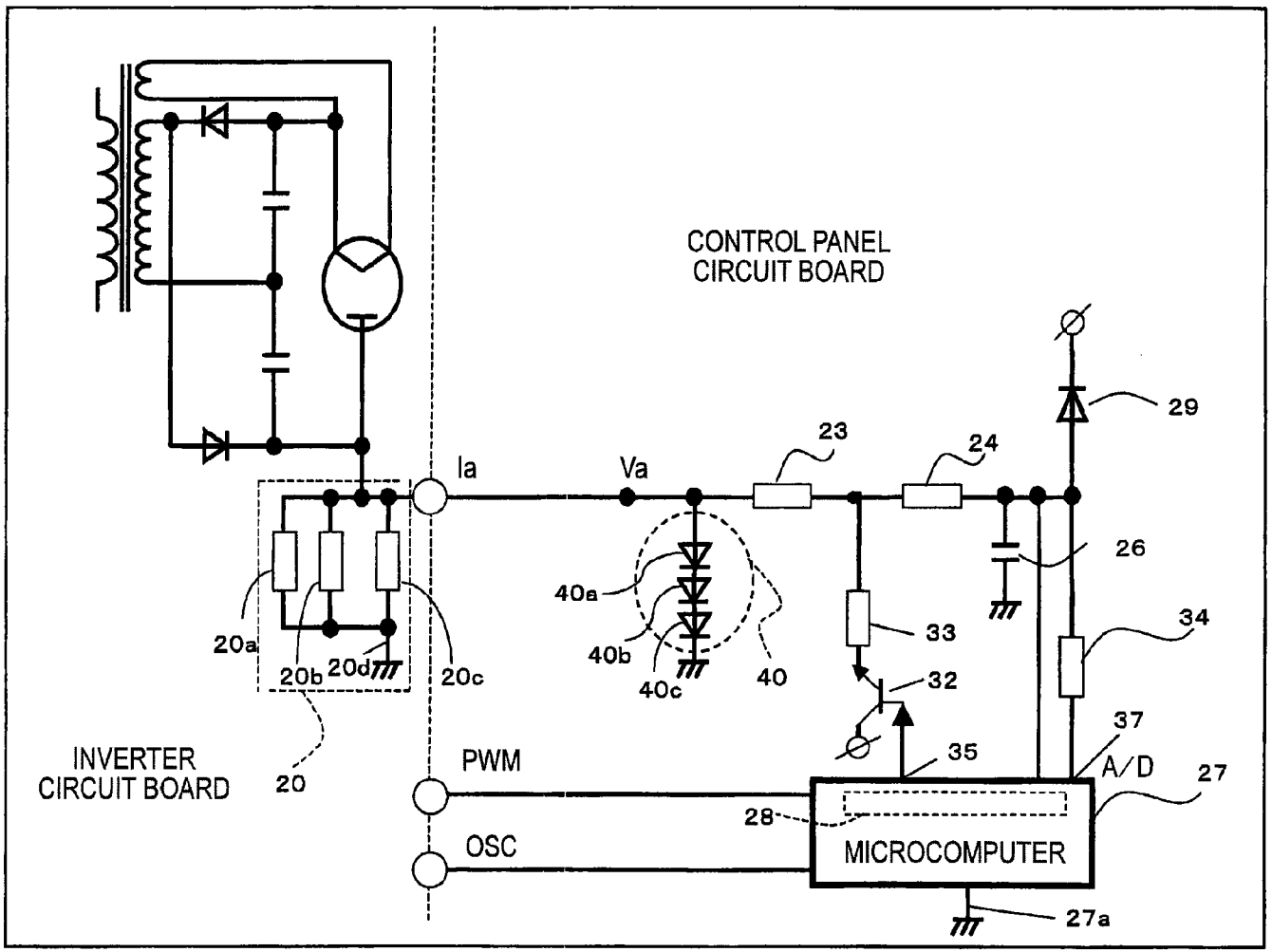
FIG. 6 It is a block diagram of a high-frequency heating device according to Embodiment 3 of the invention.
Figure 7:
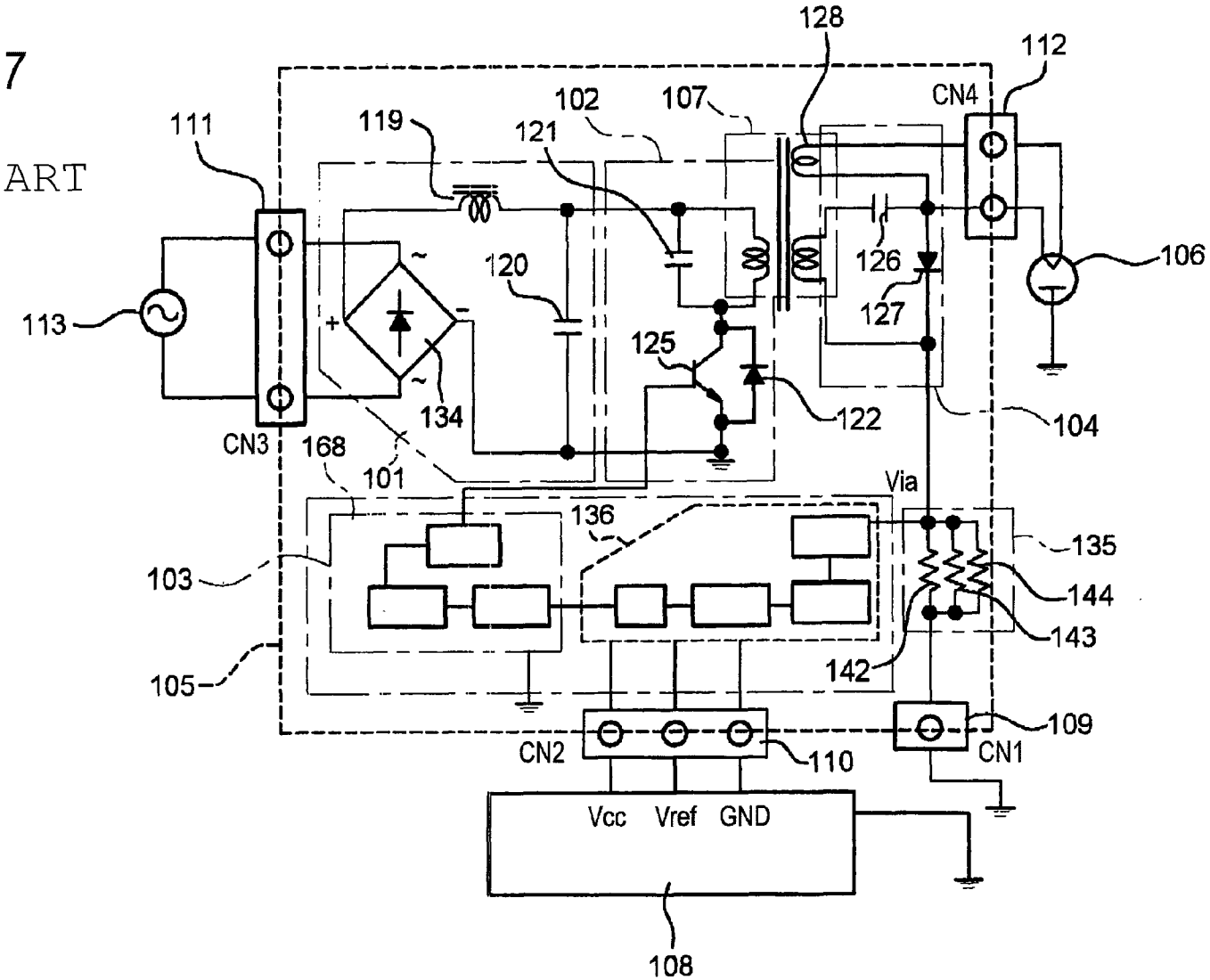
FIG.7 PRIOR ART
FIG. 7 It is a block diagram of a related art high-frequency heating device.
Figure 8:
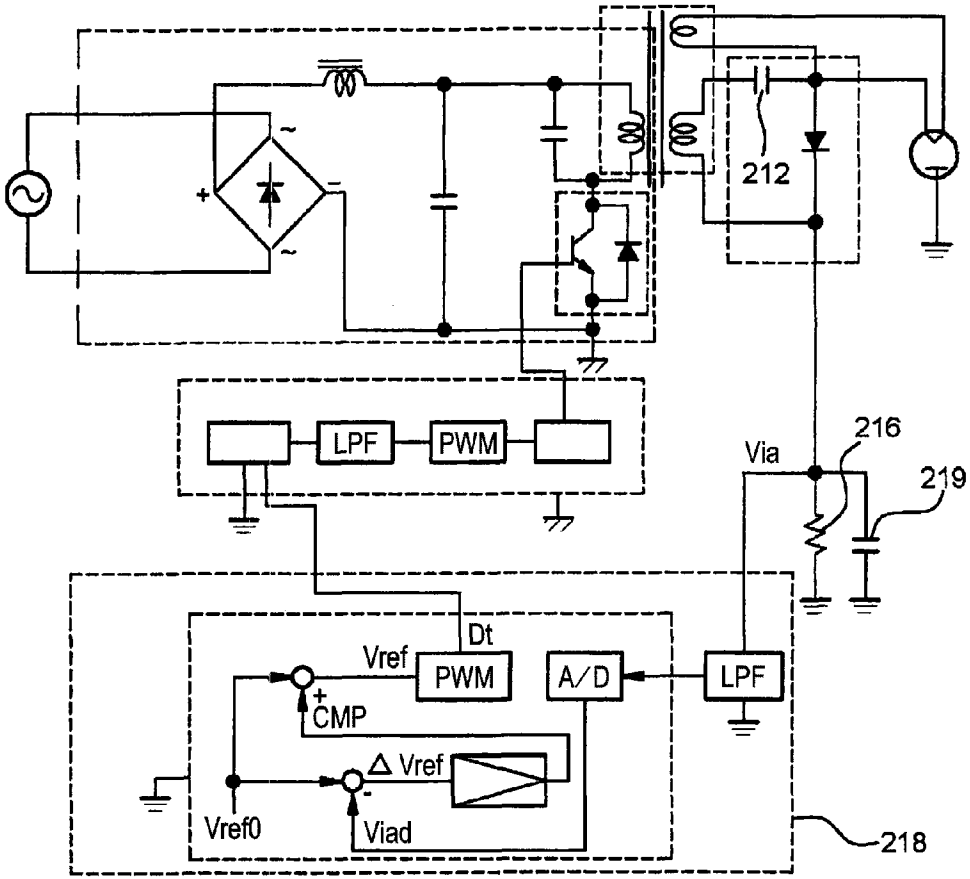
FIG.8 PRIOR ART
FIG. 8 It is a block diagram of a related art high-frequency heating device with an electric shock prevention measures installed.
Figure 9:
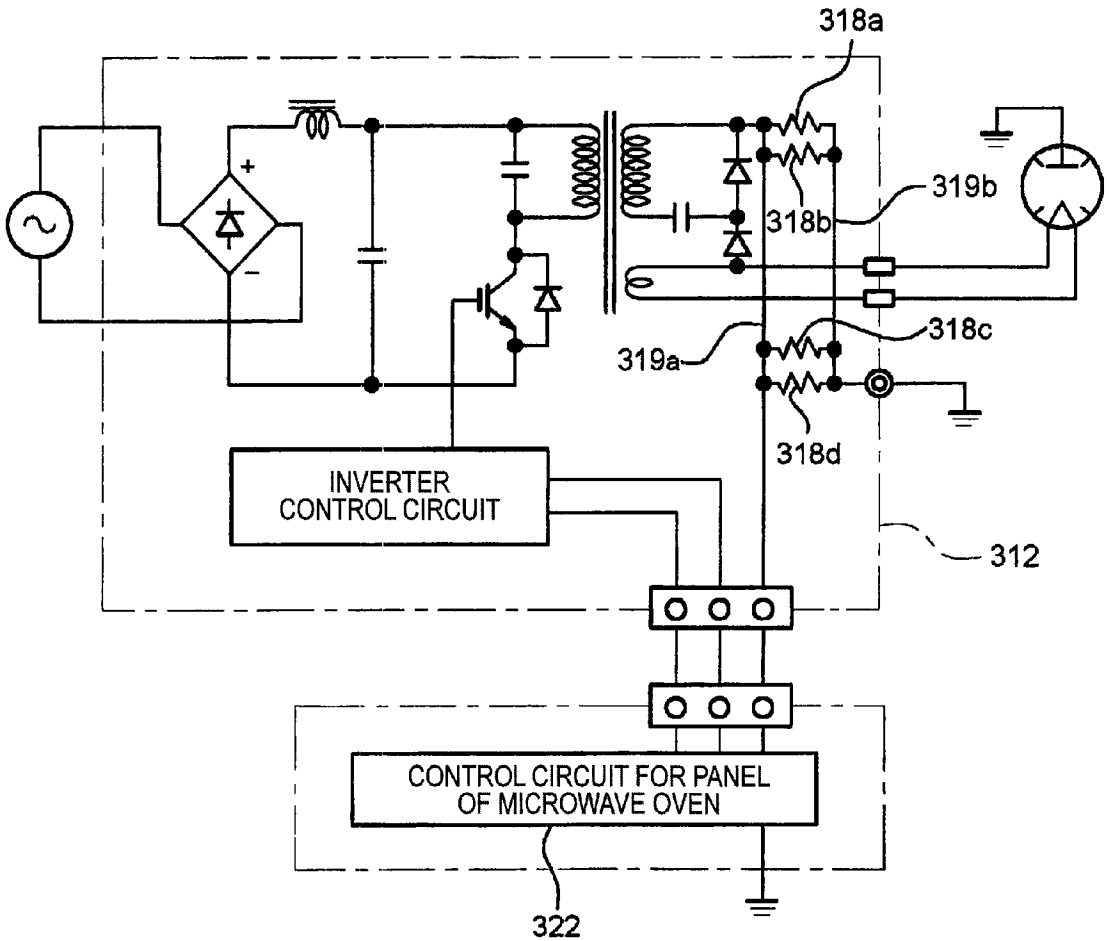
PRIOR ART FIG.9
FIG. 9 It is a block diagram of a related art microwave oven.

Next, Embodiment 3 of the invention will be described referring to figures. FIG. 6 is a block diagram of a control panel circuit board of a high-frequency heating device according to Embodiment 3 of the invention.

Embodiment 3 differs from Embodiment 2 in that a diode 40 (40*a*, 40*b*, 40*c*) is used in place of the resistor 31. In case the resistor 31 is used on the side of the control panel circuit board as in Embodiment 2, the resistor 31 is used as safety measures against disconnection or incomplete connection of the resistor 20 to the earth of the inverter circuit board, so that its resistance value must be a low one equivalent to that of the resistor 20. The reason for this is as follows. Assume that an anode current of the magnetron of about 350 mA flows in operation. In case the resistor 31 has a high resistance value, the output voltage on the side of the resistor 31 will reach a high voltage far exceeding the power voltage Vcc of the microcomputer 27 in case the resistor 20 on the inverter side has entered a floating state, and the high voltage will be applied to the microcomputer thus causing breakage of the same. It is thus necessary to set the resistance value of the resistor 31 as low as about 10 ohms. When the resistance value of the resistor 31 is 10 ohms, the output voltage of the resistor 31 is 3.5V when the resistor 20 is open, which voltage value is lower than the Vcc value 5V of general microcomputers.

The pre-operation check is accompanied by a problem that the value of a current to be supplied from the power source for the pre-operation check becomes larger as the resistance value of the resistor 31 is lowered. The value of a current supplied from the microcomputer 27 must be increased although the capability of the output current of the microcomputer 27 is naturally limited due to restrictions such as downsized chip size or the like, so that a sufficiently large current value cannot be used. This results in such new problems as an increase in the cost of an additional external driver circuit of the microcomputer 27 and an increased number of components.

The diode 40 composed of diode elements 40*a*, 40*b*, 40*c* is used in place of the resistor 31 in this embodiment. In case three diode elements are connected in series as in this embodiment, a current does not flow in the diodes unless the potential of Va becomes larger than about 1.8V, an overall voltage of the three diodes, because of the If-Vf characteristic (forward current-forward voltage characteristic) of diodes. In the pre-operation check, earth connection check of the resistor 20 on the inverter circuit board side is made with the microcomputer 27 connected to the power source Vcc. Va may be set below 1.8V by setting the resistance value of the resistor 23 to an appropriate value. With this setting, a current does not flow in the diode 40 but flows in the resistor 20 alone. It is thus unnecessary to supply a large current for checkup from the microcomputer 27.

This embodiment avoids such problems as an increase in the cost of an external microcomputer 27 and an increased number of components. The diode 40 on the side of the control panel circuit board is connected to the earth. Thus, even in the event of earth floating of the resistor 20 on the inverter side in operation, it is possible to prevent a situation, from the diode characteristic, where Va becomes considerably larger than 1.8V and generates a voltage far exceeding Vcc thus resulting in breakage of a microcomputer.

Assignment of components on each of the inverter circuit board and the control panel circuit board in this embodiment is only an example. In case at least two circuit boards (first and second circuit boards) exist in the device and either circuit board is in electric connection with a control panel the user touches for operation, the invention is advantageous in terms of prevention of an electric shock to the user.

This application is based on the Japanese Patent Application No. 2006-5316 filed Jan. 12, 2006 and its content is herein incorporated by reference.

While various embodiments of the invention have been described, the invention is not limited to the foregoing embodiments. Modifications or adaptation of the embodiments by those skilled in the art based on the description in the specification and known techniques are within the scope of the invention to be protected.

INDUSTRIAL APPLICABILITY

The high-frequency heating device according to this invention checks whether the earth of each of the two substrates is normal. This prevents an electric shock to the user in operation more reliably.

The invention claimed is:

1. A high-frequency heating device comprising:

an inverter for rectifying an AC power and converting the AC power to a high-frequency power;

a boosting transformer for boosting a high-frequency power outputted from said inverter;

a high-voltage circuit for converting the output of said boosting transformer to a high DC voltage;

a magnetron for receiving said high DC voltage and irradiating a microwave;

a first current sensing resistor provided on a first path where the anode current of said magnetron flows, said first current sensing resistor detecting the anode current and being connected to the earth of a first circuit board on which at least said high-voltage circuit is arranged;

a second current sensing resistor separated from said first current sensing resistor, said second current sensing resistor provided on a second path connected to said first path while branching therefrom and connected to the earth of a second circuit board as a substrate for a control panel that the user touches for operation; and a controller for controlling the oscillation of said magnetron by controlling said inverter;

wherein the controller applies a predetermined voltage to said first current sensing resistor and said second current sensing resistor while said inverter is not operating to determine the earth states for said first circuit board and said second circuit board, and makes control to inhibit start of operation of said inverter assuming an abnormality when determining that at least one of the earths is imperfect and to permit start of operation of said inverter when detecting that neither the earth state for said first circuit board nor the earth state for said second circuit board is imperfect.

2. The high-frequency heating device according to claim 1, wherein said controller checks the earth states for said first circuit board and said second circuit board in a predetermined cycle even while said inverter and said magnetron are operating.

3. The high-frequency heating device according to claim 1, wherein said second path is connected to a power potential generating said predetermined voltage and includes a selector switch connected between said power potential and said second current sensing resistor, said second path connects said power potential to said first path by turning on said selector switch, and said controller determines the earth states for said first circuit board and said second circuit board assuming a voltage obtained by said second current sensing resistor as said voltage value.

4. The high-frequency heating device according to claim 3, wherein said controller include an input terminal connected to said first path for detecting said voltage value and an output terminal arranged between said second current sensing resistor and said selector switch.

5. The high-frequency heating device according to claim 1, further comprising a plurality of resistor elements connected to a subsequent stage of said first current sensing resistor, connected to the earth of said second circuit board and connected parallel to each other.

6. The high-frequency heating device according to claim 1, further comprising a diode connected to a subsequent stage of said first current sensing resistor and connected to the earth of said second circuit board.

7. The high-frequency heating device according to claim 2, wherein said second path is connected to a power potential generating said predetermined voltage and includes a selector switch connected between said power potential and said second current sensing resistor, said second path connects said power potential to said first path by turning on said selector switch, and said controller determines the earth states for said first circuit board and said second circuit board assuming a voltage obtained by said second current sensing resistor as said voltage value.

8. The high-frequency heating device according to claim 7, wherein said controller include an input terminal connected to said first path for detecting said voltage value and an output terminal arranged between said second current sensing resistor and said selector switch.

* * * * *